United States Patent [19]

Benseler

[11] 4,174,121

[45] Nov. 13, 1979

[54] CROSS-COUNTRY BOOT AND SKI BINDING

[75] Inventor: Hans Benseler, Hemmingen, Fed. Rep. of Germany

[73] Assignee: PUMA-Sportschuhfabriken Rudolf Dassler KG, Fed. Rep. of Germany

[21] Appl. No.: 880,939

[22] Filed: Feb. 24, 1978

[30] Foreign Application Priority Data

Feb. 24, 1977 [DE] Fed. Rep. of Germany ..... 2707887

[51] Int. Cl.[2] ..... A63C 9/00

[52] U.S. Cl. ..... 280/615; 36/117

[58] Field of Search ..... 280/615, 614, 611; 36/117, 118, 119, 120, 121

[56] References Cited

U.S. PATENT DOCUMENTS

| | | | |
|---|---|---|---|
| 2,246,152 | 6/1941 | Wallace | 36/117 X |
| 4,106,223 | 8/1978 | Benseler | 36/117 |
| 4,108,467 | 8/1978 | Kreyenbuhl | 280/615 |

FOREIGN PATENT DOCUMENTS

| | | | |
|---|---|---|---|
| 2610041 | 10/1976 | Fed. Rep. of Germany | 280/615 |
| 980478 | 5/1951 | France | 280/615 |
| 37163 | 4/1923 | Norway | 280/615 |

*Primary Examiner*—Joseph F. Peters, Jr.
*Assistant Examiner*—Milton L. Smith
*Attorney, Agent, or Firm*—Craig & Antonelli

[57] ABSTRACT

A ski binding wherein a cross-country ski boot is attached to a ski by way of an extension portion of an outer sole projecting beyond a forwardly located tip of the ski boot. The extension portion has on its top side a transversely oriented rib-like bulge. A reinforcing insert is arranged in the outer sole of the cross-country ski boot with the insert extending at least from a ball portion of the outer sole into a zone of the rib-like bulge. A fastening arrangement is provided for clampingly engaging the rib-like bulge with the fastening arrangement extending in a claw-like manner over the rib-like bulge so as to clampingly embrace the bulge.

16 Claims, 2 Drawing Figures

CROSS-COUNTRY BOOT AND SKI BINDING

Figure 1:
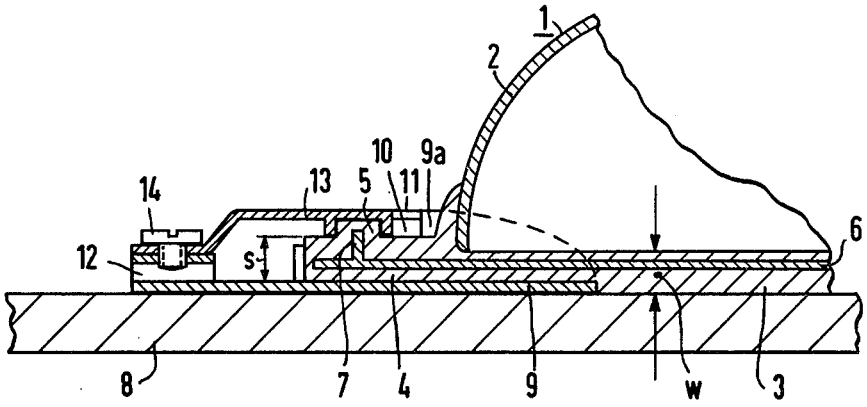

The present invention relates to a ski binding and, more particularly, to a ski binding for a cross-country ski boot wherein a cross-country ski boot is attached to the ski by way of an extension portion of an outer sole of the cross-country ski boot, which extension portion projects beyond a front tip of the cross-country ski boot with the extension portion having a transversely oriented rib-like bulge provided on a top side thereof.

In proposed ski bindings of the afore-mentioned type, the cross-country ski boot is normally articulated by a thin cross bolt which penetrates the rib-like bulge with the bolt being attached at its respective ends to the ski. This type of ski binding can result in a weakening of the sole or tread portion of the cross-country ski boot penetrated by the cross bolt and can also lead to premature wear.

The aim underlying the present invention essentially resides in providing a ski binding which has a comparatively high endurance strength.

According to one feature of the present invention, the outer sole or tread of the cross-country ski boot is provided with an insert of flexible sheet steel or the like which extends at least from the ball portion of the outer sole into an area of the rib-like bulge. The sheet steel provides not only for reinforcement of the outer sole or tread, but also ensures the transmission of high guiding forces from the cross-country ski boot to the ski.

According to a further feature of the present invention, a fastening means for the cross-country ski boot is provided which includes a fastening element arranged on the ski, which fastening element extends over the rib-like bulge from above so as to clampingly engage the rib-like bulge.

According to the present invention, the extension portion which serves for attaching the cross-country ski boot is reinforced by the flexible sheet steel formed as a steel plate up into a zone of the rib-like bulge with the secure fixation being achieved by a fastening tongue-like member extending claw-like from above over the bulge. The claw-like or clamping portion of the tongue member is provided with an effective indentation corresponding in its cross-section to the cross-section of the rib-like bulge for embracing the rib-like bulge.

Moreover, according to the present invention, it is possible to have the steel plate extend, by attachment or by an angled portion, within or essentially within the rib-like bulge or also to angle the steel plate below the bulge upwardly so that the angled portion terminates within or essentially within the rib-like bulge. Additionally, the steel plate may terminate at a position rearward of the rib-like bulge.

According to further features of the present invention, the fastening means for the cross-country ski boot may also include a plate attached by suitable securing means to the ski with the plate being angled at the sides thereof so as to form obliquely extending abutment surfaces. Additionally, the plate may be angled in an upward direction at a forward portion of the ski binding so as to form lateral jaws which are oriented in a longitudinal direction of the ski. Inwardly angled tongues may be provided in an area of the lateral jaws with the spacing of the tongues from the plate corresponding to a wall thickness of the extension portion plus a thickness of the height of the rib-like bulge.

Accordingly, it is an object of the present invention to provide a cross-country boot and ski binding therefor which avoid by simple means the shortcomings and disadvantages encountered in the prior art.

Another object of the present invention resides in providing a cross-country boot and ski binding therefor which have a high endurance strength.

A further object of the present invention resides in providing a cross-country boot and ski binding therefor which ensure the transmission of high guiding forces from the cross-country ski boot to the ski.

An additional object of the present invention resides in providing a cross-country boot and ski binding therefor which are simple in construction and, therefore, inexpensive to manufacture.

Yet another object of the present invention resides in providing a cross-country boot and ski binding therefor which function reliably under all conditions.

Figure 2:
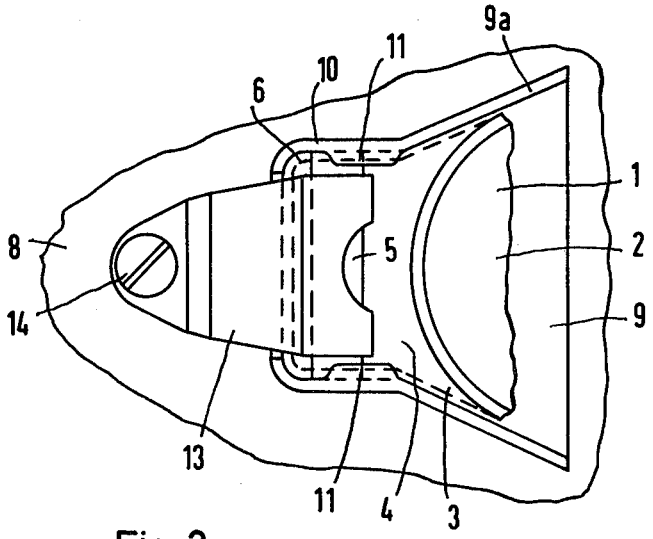

These and other objects, features and advantages of the present invention will become more apparent from the following description when taken in connection with the accompanying drawings which show, for the purposes of illustration only, one embodiment in accordance with the present invention, and wherein:

FIG. 1 is a longitudinal cross-sectional view, through a cross-country ski boot, in an area of a ski binding in accordance with the present invention; and FIG. 2 is a partial top view of a section of the ski binding of FIG. 1.

Referring now to the drawings wherein like reference numerals are used in both views to designate like parts and, more particularly to FIG. 1, according to this figure, a cross-country ski boot is provided which includes a shank 1 and a forwardly located tip 2 attached to an outer sole or tread 3 which extends along the entire bottom of the cross-country ski boot. The outer sole or tread 3 is made of a rubber material or the like and is provided with an integral extension portion 4 which extends beyond the tip 2 of the cross-country ski boot. The integral extension portion 4 has a height or wall thickness S which is larger than a medium height or wall thickness W of the outer sole or tread 3 located beneath the shank 1.

A rib-like bulge 5 having a rectangular cross-section is integrally formed on the extension portion 4 at approximately the forward third and/or forward half of the extension portion 4. The rib-like bulge 5 extends in a direction transverse to and over the entire width of the extension portion 4.

A steel plate 6 extends at least from a ball portion of the cross-country ski boot to a position beyond a forward end of the rib-like bulge 5. The steel plate 6 may extend over the entire length of the outer sole or tread 3, if desired. The steel plate 6 is embedded approximately centrally in the outer sole or tread 3. The steel plate 6 can be firmly attached to the outer sole or tread 3 and can be provided with an angled portion 7 which extends into or essentially into the rib-like bulge 5. The steel plate 6 has a great amount of flexibility, but nevertheless imparts to the outer sole or tread 3 a satisfactory strength in order to be able to, inter alia, adequately transmit high guiding forces from the cross-country ski boot to the ski 8. If desired, the steel plate 6 may terminate at a position rearward of the rib-like bulge 5.

The fastening means for the cross-country ski boot includes a plate 9 attached by suitable securing means such as, for example, screws or the like to the ski 8. The plate 9 is angled at the sides thereof so as to form obliquely extending abutment surfaces 9*a*. Additionally, the plate 9 is angled in an upward direction at a forward portion of the ski binding so as to form abutment surfaces or lateral jaws 10 which are oriented in a longitudinal direction of the ski 8. Inwardly angled tangs or tongues 11 may be provided in an area of the abutment surfaces or lateral jaws 10 with the spacing or height of the tangs or tongues 11 from the plate 9 corresponding at least to the wall thickness or height S of the extension portion 4 plus the thickness of the rib-like bulge 5.

A mounting bracket 12 is arranged at a forward zone of the cross-country ski binding. The mounting bracket 12 includes a threaded portion for detachably mounting a tongue-like member 13 by way of a fastener such as, for example, a screw 14 or the like. The tongue-like member 13 is provided at a free or rear end thereof with a U-shaped cross-section clamping portion which extends over and embraces the rib-like bulge 5 5 so as to fix the extension portion 4 in a position with respect to a front and rear of the ski 8. The cross-section of the rib-like bulge corresponds to the cross-section of the clamping portion so that, after the screw 14 is tightened, the tongue-like member 13 rests flush and firmly over the rib-like bulge 5.

Thus, the tongue-like member 13 holds the rib-like bulge 5 fixedly against displacement. However, an articulation of the cross-country ski boot relative to the ski 8 is attained, which articulation is required for guiding the ski 8 and is suitable for conducting the running motion. The strength and durability of the cross-country ski binding are attained by virtue of the reinforcement imparted thereto by the steel plate 6 arranged in the outer sole or tread 3.

While I have shown and described only one embodiment in accordance with the present invention, it is understood that the same is not limited thereto, but is susceptible of numerous changes and modifications as would be known to a person skilled in the art to which it pertains, and I therefor do not wish to be restricted to the details shown and described herein, but intend to cover all such changes and modifications as are encompassed by the scope of the appended claims.

I claim:

1. In combination with a cross-country ski, a cross-country ski boot having an outer sole which includes an extension portion projecting beyond a forwardly located tip of the cross-country ski boot for attaching the ski boot to the cross-country ski, and a transversely oriented rib-like bulge arranged on a top side of the extension portion, wherein a reinforcing insert is arranged in the outer sole of the cross-country ski boot, said insert extending at least from a ball portion of the outer sole into a zone of the rib-like bulge, and a fastening means is arranged on the cross-country ski and has a clamping portion extending over and embracing the rib-like bulge, the cross-section of the clamping portion corresponding to the cross-section of the rib-like bulge, whereby the cross-country ski boot is secured against displacement longitudinally of the ski.

2. The combination according to claim 1, wherein said reinforcing insert is a steel plate.

3. The combination according to claim 1, wherein said reinforcing insert includes an outwardly angled portion in an area below the rib-like bulge, and the angled portion terminates in one of within or essentially within the rib-like bulge.

4. The combination according to claim 3, wherein the rib-like bulge is arranged on the extension portion at a predetermined spacing from a free end thereof.

5. The combination according to claim 4, wherein the rib-like bulge is located approximately in at least one of a forward third and a forward half of the extension portion.

6. The combination according to claim 1, wherein the rib-like bulge and the clamping portion have corresponding substantially rectangular cross-sectional configurations.

7. The combination according to claim 6, wherein the extension portion has a predetermined wall thickness, and said predetermined wall thickness is substantially larger than a wall thickness of a portion of the outer sole provided beneath a shank of the cross-country ski boot.

8. The combination according to claim 7, wherein the fastening means further includes a tongue member having a first end extending over the rib-like bulge between lateral jaws of the ski, the clamping portion being provided at said first end, and a second end of the tongue member is detachably connected with at least one of the ski and a plate member carrying the ski binding.

9. The combination according to claim 8, wherein the reinforcing insert terminates at a position rearward of the rib-like bulge.

10. The combination according to claim 2, wherein the rib-like bulge is arranged on the extension portion at a predetermined spacing from a free end thereof.

11. The combination according to claim 10, wherein the rib-like bulge is located approximately in at least one of a forward third and a forward half of the extension portion.

12. The combination according to claim 10, wherein the reinforcing insert terminates at a position rearward of the rib-like bulge.

13. The combination according to claim 2, wherein the rib-like bulge and the clamping portion have corresponding substantially rectangular cross-sectional configurations.

14. The combination according to claim 2, wherein the extension portion has a predetermined wall thickness, and said predetermined wall thickness is substantially larger than a wall thickness of a portion of the outer sole provided beneath a shank of the cross-country ski boot.

15. The combination according to claim 2, wherein the fastening means further includes a tongue member having a first end extending over the rib-like bulge between lateral jaws of the ski, the clamping portion being provided at said first end, and a second end of the tongue member is detachably connected with at least one of the ski and a plate member carrying the ski binding.

16. The combination according to claim 2, wherein said reinforcing insert includes an outwardly angled portion in an area below the rib-like bulge, and the angled portion terminates in one of within or essentially within the rib-like bulge.

* * * * *